US007104178B1

(12) United States Patent
Zank

(10) Patent No.: US 7,104,178 B1
(45) Date of Patent: Sep. 12, 2006

(54) ACTIVE ARMOR INCLUDING MEDIAL LAYER FOR PRODUCING AN ELECTRICAL OR MAGNETIC FIELD

(75) Inventor: Paul A. Zank, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/871,146

(22) Filed: Jun. 18, 2004

Related U.S. Application Data

(63) Continuation-in-part of application No. 10/323,383, filed on Dec. 18, 2002, now Pat. No. 6,758,125.

(51) Int. Cl.
*F41H 5/007* (2006.01)

(52) U.S. Cl. ..... 89/36.17; 89/36.02

(58) Field of Classification Search ..... 89/36.17, 89/36.02

See application file for complete search history.

(56) References Cited

U.S. PATENT DOCUMENTS

| | | | | | |
|---|---|---|---|---|---|
| 3,100,444 | A * | 8/1963 | Charske et al. | 181/116 |
| 3,287,692 | A * | 11/1966 | Turner | 367/161 |
| 4,061,815 | A * | 12/1977 | Poole, Jr. | 428/215 |
| 4,292,882 | A * | 10/1981 | Clausen | 89/36.02 |
| 4,368,660 | A * | 1/1983 | Held | 89/36.17 |
| 4,545,286 | A * | 10/1985 | Fedij | 89/36.02 |
| 4,662,288 | A * | 5/1987 | Hastings et al. | 109/2 |
| 4,741,244 | A * | 5/1988 | Ratner et al. | 89/36.17 |
| 4,754,441 | A * | 6/1988 | Butler | 367/157 |
| 4,867,077 | A * | 9/1989 | Marlow et al. | 109/36 |
| 4,869,152 | A * | 9/1989 | Marlow et al. | 89/36.17 |
| 4,881,448 | A * | 11/1989 | Medin et al. | 89/36.02 |
| 4,981,067 | A * | 1/1991 | Kingery | 89/36.17 |
| 5,045,371 | A * | 9/1991 | Calkins | 428/49 |
| 5,070,764 | A * | 12/1991 | Shevach et al. | 89/36.17 |
| 5,413,027 | A * | 5/1995 | Mixon | 89/36.17 |
| 5,516,595 | A * | 5/1996 | Newkirk et al. | 428/697 |
| 5,637,824 | A * | 6/1997 | Benyami | 89/36.17 |
| 5,905,225 | A * | 5/1999 | Joynt | 89/36.02 |
| 5,915,291 | A * | 6/1999 | Weihrauch et al. | 89/36.01 |
| 6,352,649 | B1 * | 3/2002 | McCallum et al. | 252/62.55 |
| 6,393,921 | B1 * | 5/2002 | Grimes et al. | 73/728 |
| 6,474,213 | B1 * | 11/2002 | Walker et al. | 89/36.17 |
| 6,622,608 | B1 * | 9/2003 | Faul et al. | 89/36.17 |
| 6,703,104 | B1 * | 3/2004 | Neal | 428/118 |
| 6,758,125 | B1 * | 7/2004 | Zank | 89/36.17 |
| 2003/0150321 | A1 * | 8/2003 | Lucuta et al. | 89/36.02 |

* cited by examiner

*Primary Examiner*—Stephen M. Johnson
(74) *Attorney, Agent, or Firm*—Daniel J. Long

(57) ABSTRACT

An active armor system, which includes a first armor layer and a second armor layer. An interior space is interposed between the first and second armor layer. A third layer is also positioned preferably adjacent to and on the inner side of the first layer. This third layer is comprised of a material selected from a piezoelectric material, and electrostrictive material, and a magnetostrictive material. The third layer may also be characterized as any material capable of producing an electrical or magnetic field within the space in response to the application of mechanical force on this third layer. The application of force on the third layer as a result of the impacting of a shaped charge projectile on the first armor layer will result in the production of an electric or magnetic charge in the interior space which will disrupt the formation of the shaped charge gas jet so as to prevent the penetration of the second armor layer.

7 Claims, 7 Drawing Sheets

ACTIVE ARMOR INCLUDING MEDIAL LAYER FOR PRODUCING AN ELECTRICAL OR MAGNETIC FIELD

CROSS REFERENCE TO RELATED APPLICATION

This is a continuation-in-part of U.S. application Ser. No. 10/323,383, filed Dec. 18, 2002 now U.S. Pat. No. 6,758, 125, entitled "Active Armor Including Medial Layer for Producing An Electrical or Magnetic Field", the contents of which are incorporated herein by reference.

BACKGROUND OF THE INVENTION

1. Field of the Invention

The present invention relates to armaments and more particularly to reactive and active armor.

2. Brief Description of Prior Developments

The prior art discloses various arrangements of active armor in which a medial layer is positioned between an outer and an inner armor layer with a medial explosive or non-explosive layer which disrupts a shaped charge to prevent penetration of the overall armor system.

U.S. Pat. No. 4,368,660, for example, discloses an arrangement in which an explosive charge is positioned between two armor layers. On detonation of the explosive, the armor layers are displaced from one another to disrupt the shaped charge jet.

U.S. Pat. No. 4,881,448 discloses an active armor arrangement consisting of two mutually parallel metal plates with an interior sheet of incompressible formaldehyde compound. Upon impact with a hollow jet explosive charge, the incompressible layer causes the outer metal sheets to push outwardly into the path of a hollow jet explosive charge.

U.S. Pat. No. 4,867,077 discloses an active armor in which explosive material is imbedded between layers of a resilient material which are contained between upper and lower rigid plates in a sandwich structure. A construction for application of active armor to a structure to be protected comprises a plurality of such packages, a plurality of projections attached to the structure and a plurality of holder each attachable to the other and running between adjacent projections. Each of the holders holds an edge of one of the packages so that each projection is thereby attached to at least one of the packages by the holder.

It has also been suggested that performance of active armor may be improved by providing a medial space between an outer and an inner armor layer and providing an electrical generator to create an electric or magnetic field in the space between the outer and inner armor layers. A disadvantage to such an arrangement might be that the necessity to add additional weight and space requirement in order to provide an electrical generator of sufficient capacity to provide the necessary parent supply might add undue weight and space requirements when such an armor is used on a mobile vehicle. A further disadvantage of such an arrangement might be that the effectiveness of such armor might be reduced or effectively lost in the event of a power failure during operations, or in the event that the generator was shut down during non-operational periods.

A need, therefore, exists for active armor in which an electrical or magnetic field may be provided in the space between an outer and inner armor layers which is not dependent on a necessity to be continually generating electrical power.

SUMMARY OF THE INVENTION

The present invention is an active armor system, which includes a first armor layer and a second armor layer. A space is interposed between the first and second armor layer. A third layer is also positioned preferably adjacent to and on the inner side of the first layer. This third layer is comprised of a material selected from a piezoelectric material, an electrostrictive material, and a magnetostrictive material. The third layer may also be characterized as any material capable of producing an electrical or magnetic field within the space in response to the application of mechanical force on this third layer. The application of force on the third layer as a result of the impacting of a shaped charge projectile on the first armor layer will result in the production of an electric or magnetic charge in the interior space which will disrupt the formation of the shaped charge gas jet so as to prevent the penetration of the second armor layer.

BRIEF DESCRIPTION OF THE DRAWINGS

The present invention is further described with reference to the accompanying drawing in which.

DETAILED DESCRIPTION OF THE PREFERRED EMBODIMENT

Figure 1:
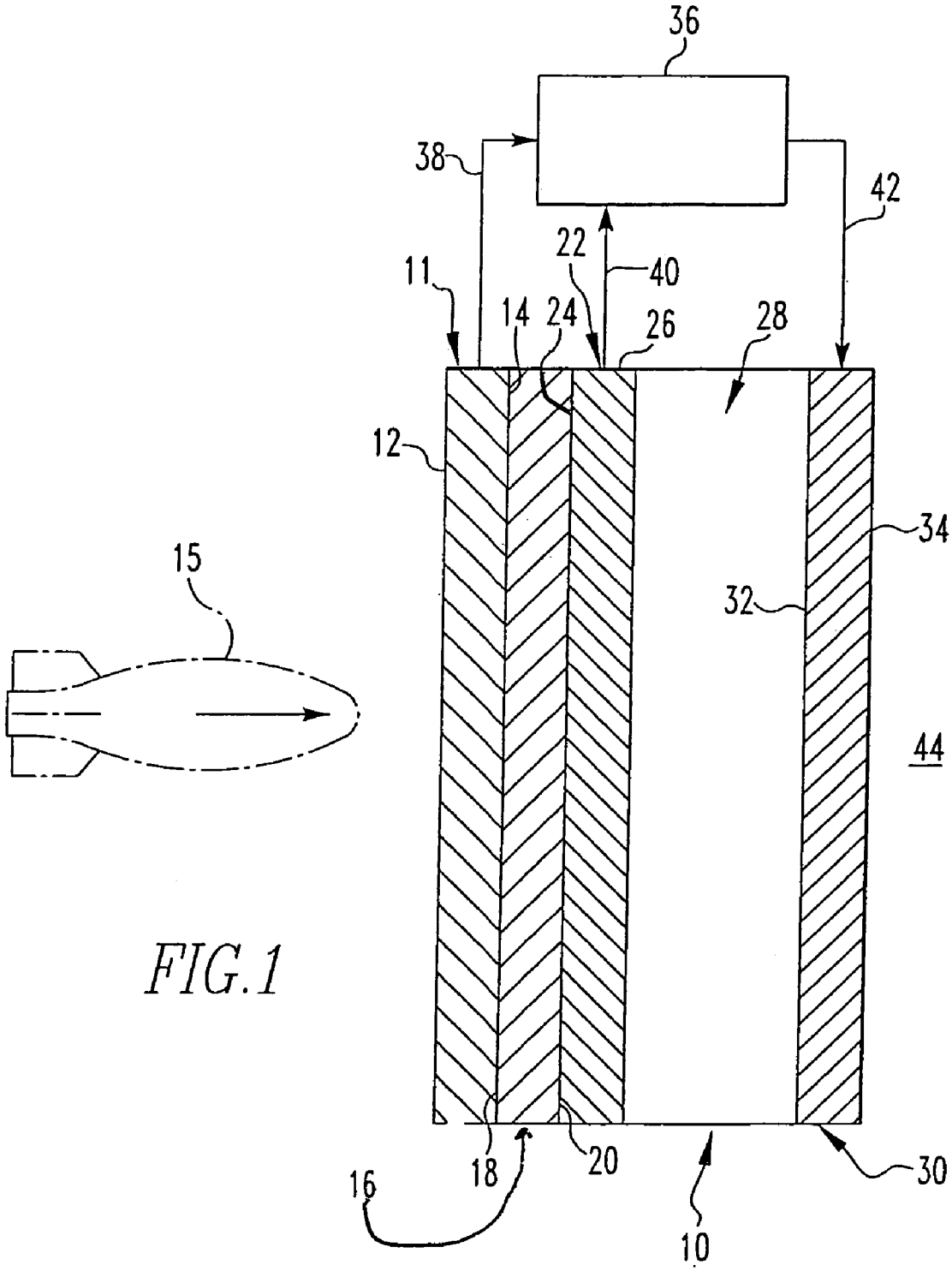
FIG. 1 is a vertical cross-sectional view of a preferred embodiment of the active armor system of the present invention.

Referring to FIG. 1, the active armor system of the present invention is shown generally at numeral 10. This active armor system 10 includes a front armor layer 11 which would preferably consist of suitable steel alloy or some other ferromagnetic material. The front armor layer 11 has a front face 12 and a rear face 14. The conventional shaped charge projectile 15 (which is not part of the invention) and against which this system is designed to protect travels in the direction of the arrow and would ordinarily be expected to impact against the front face 12 of the outer armor layer 11. Adjacent the front armor layer 11 there is an interior layer 16 which includes a front face 18 and a rear face 20. This front face 18 would abut the rear face 14 of the front armor layer 11. The interior layer 16 is comprised of a suitable piezoelectric, electrostrictive, or magnetostrictive material. If a magnetostrictive material is selected, it would preferably be a Terfernol alloy which has a formula of Th.sub0.27 Dy.sub0.73 Fe.sub2. Alternatively the magnetostrictive material may be a Terfernol-D alloy (a "Doped" Terfernol alloy) which has a formula of Tb.sub0.27[.]Dy.sub0.73 Fe.sub1.95 and which has an additive which is a Group III or Group IV element such as Si or Al. Inwardly adjacent the interior layer 16 there is an electrode 22 which has a front face 24 and a rear face 26. The front face 24 of electrode 22 would abut the rear face 20 of interior layer 16.

If a piezoelectric material is used, preferred piezoelectric ceramics would be barium titanate, lead zirconate titanate (PZT) and quartz. Other suitable piezoelectric ceramics may be strontium titanate, potassium tantalite niobate, potassium tantalite, lithium niobate, and barium sodium niobate. If an electrostrictive ceramic material is used, preferred materials would be lead magnesium niobate and lead titanate.

Inwardly adjacent the interior layer 16 there is an electrode 22 which has a front face 24 and a rear face 26. The front face 24 of electrode 22 would abut the rear face 20 of interior layer 16. Inwardly adjacent the rear face 26 of electrode 22 there is an interior air space 28. Alternatively, this air space 28 may be a vacuum space or may be a space filled with an inert gas. On the rear side of the armor system there is a rear armor layer 30 which has a front face 32 and a rear face 34. Armor layer 11 is electrically connected to solid state power converter 36 by line 38. Layer 26 is electrically connected to solid state power computer 36 by line 40. The front face 32 is adjacent the air space 38 and the rear face 34 is adjacent a space to be protected 44 as, for example, the interior compartment of a tank or armored personnel carrier.

In operation, when a shaped charge projectile as, for example, projectile 15 impacts the front face 12 of the front armor layer 11, the force of that impact is transmitted through the front armor layer 11 to the interior layer 16. An electrical charge is transmitted to the electrode 22 which produces an electrical or magnetic field in the air space 28. The shaped charge of projectile 15 would be expected to form a gas jet (not shown). If this gas jet penetrates the outer armor layer 10 as well as the interior layer 16 and the electrode 22, small, often molten, particles of the front armor layer 11 would enter the air space 28. Because, however, of the electrical or magnetic field produced as a result of the application of mechanical force on the interior layer 16, the formation of the shaped charge gas jet is disrupted so that the rear armor layer 30 would not be penetrated.

Figure 2:
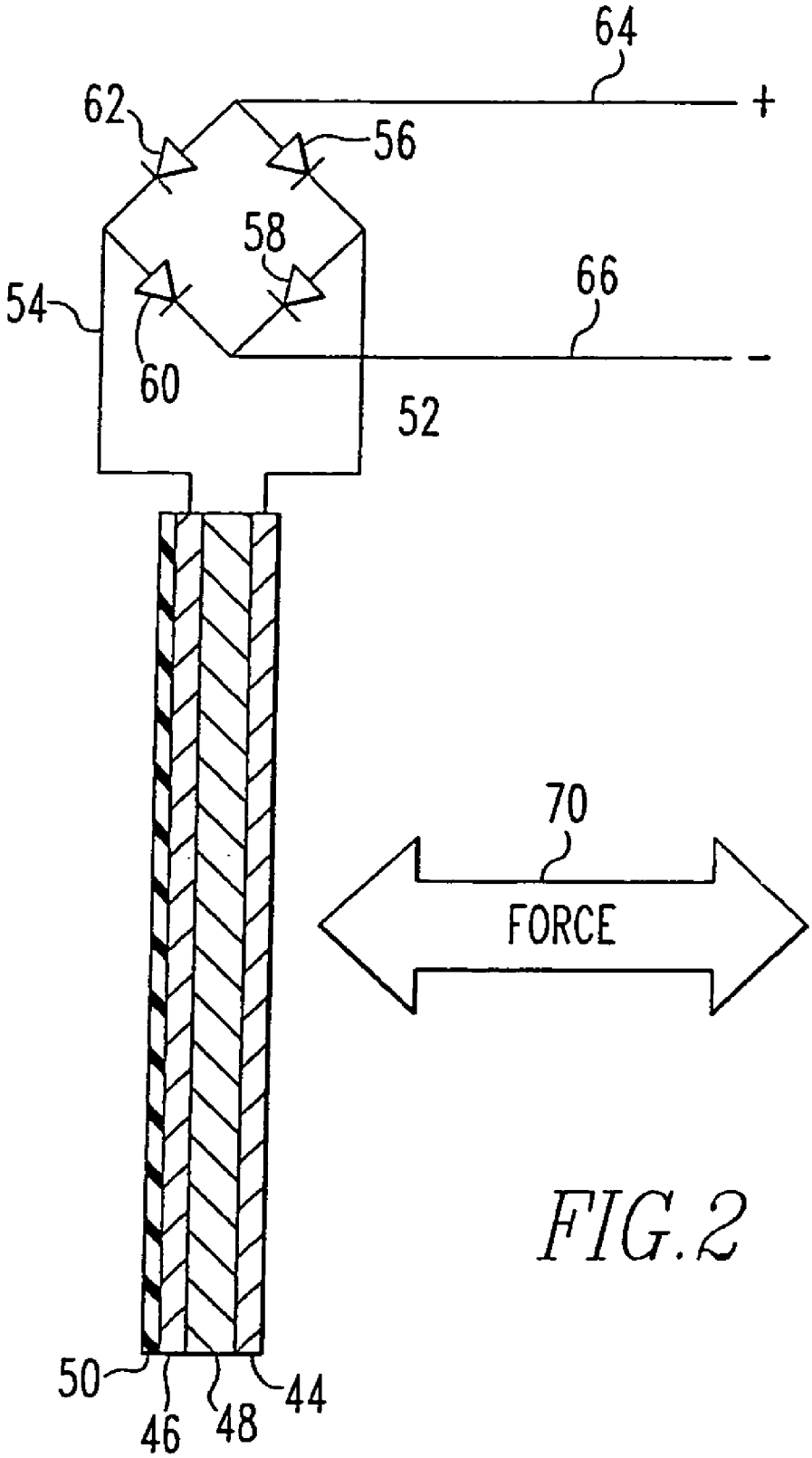
FIG. 2 is a vertical cross-sectional view of another preferred embodiment of the active armor system of the present invention.

Referring to FIG. 2, an embodiment is shown with a conductive plate 44 and a conductive plate 46 between which there is a piezoelectric material layer 48. An electrostrictive or magnetostrictive material may be substituted for the piezoelectric material in layer 48. There is an insulation layer 50. Line 52 extends from conductive layer 44 and line 54 extends from conductive layer 46 to a circuit including diodes 56, 58, 60 and 62. This circuit is connected by line 64 to a positive charge and by line 66 to a negative charge. Force vectors 70 which may impinge toward or away from conductive layer 44.

Figure 3:
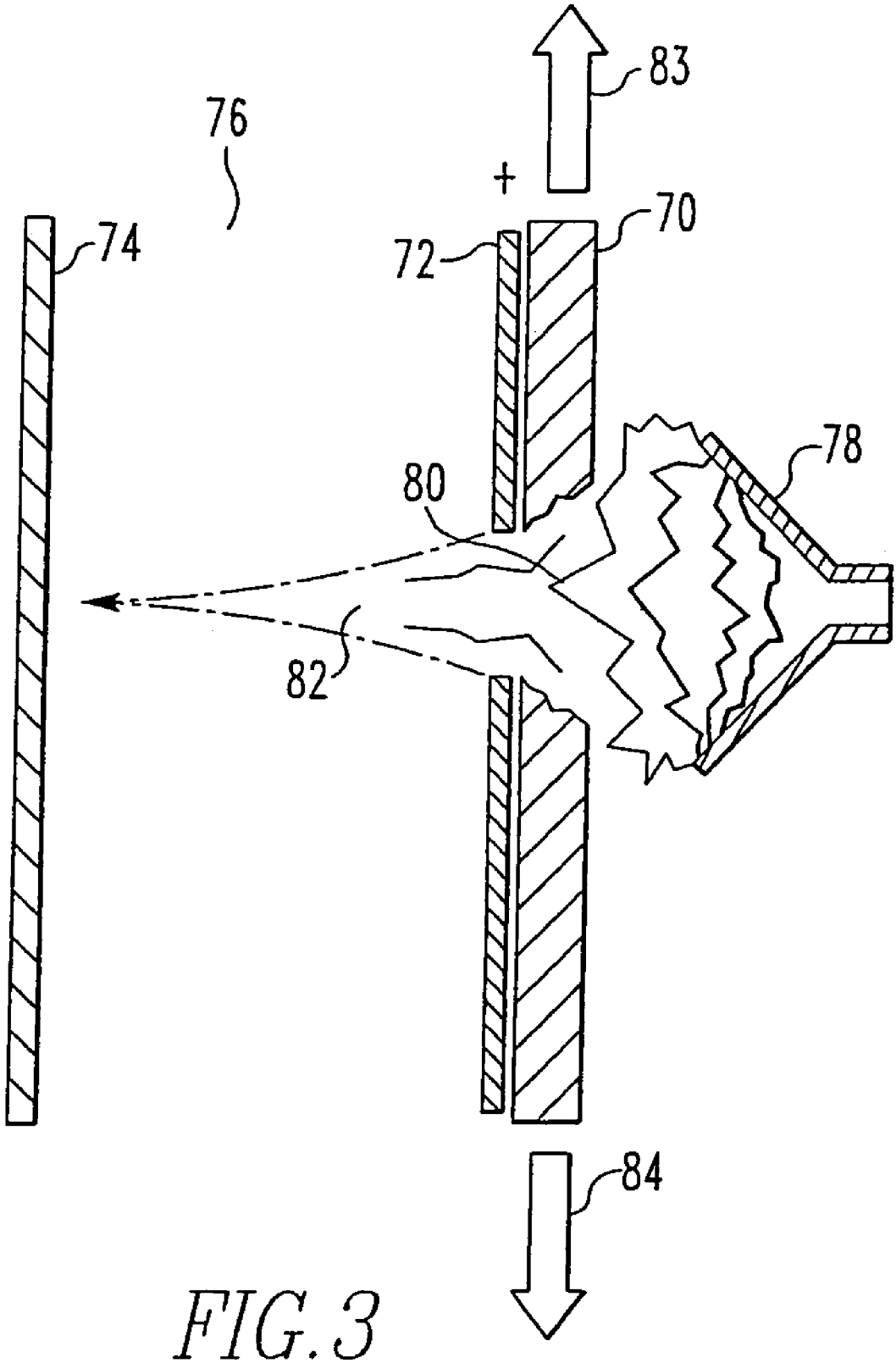
FIG. 3 is a vertical cross-sectional view of a third preferred embodiment of the active armor system of the present invention.

Referring to FIG. 3, another embodiment of active armor system of the present invention is shown in which there is a front piezoelectric plate 70. An electrostrictive material or magnetostrictive material may be substituted for the piezoelectric material in this plate 70. Between conductive plate 72 and conductive plate 74 an air space 76 is positioned. Conductive plate 74 may be the exterior of a vehicle to be protected. A detonating shaped charge 78 produces an aperture 80 in the exterior piezoelectric plate 70 and front conductive plate 72 to produce a jet stream 82 of gas and molten metal in the air space 76. The detonation of the shaped charge 78 causes the application of force vectors 83 and 84 on the exterior piezoelectric plate 70 which produces a positive charge on conductive plate 72 and a negative plate on conductive charge 84 so as to disrupt the jet stream 82 of gas and molten metal and prevent its penetration of conductive plate 74. A shock wave resulting from the detonation of the shaped charge 78 will move through the piezoelectric plate 70 at about 10,000 ft/sec ($V_{pp}$). The shaped charge jet stream 82 will move through the space 76 at about 30,000 ft/sec ($V_{jet}$). The available electrical energy will be proportional to $P_i*(V_{pp}*t)\hat{}Z$. It should be understood that the distance between the piezoelectric plate 70 and the conductive plate 74 will be large enough to allow the shock wave to cover an area big enough to generate sufficient electrical energy to disrupt the jet stream 82.

Figure 4:
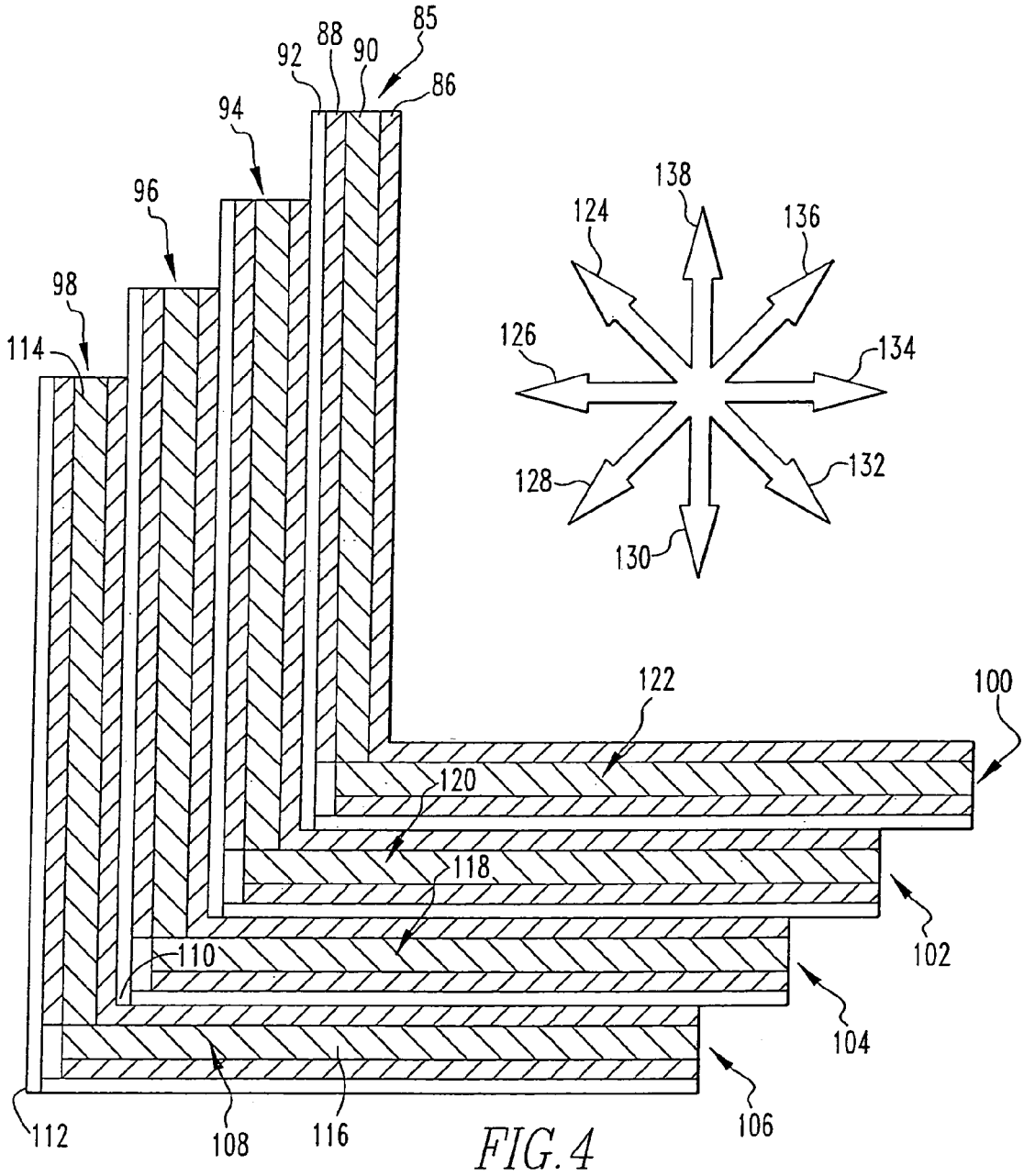
FIG. 4 is a vertical cross-sectional view of a fourth preferred embodiment of the active armor system of the present invention.

Referring to FIG. 4, in another embodiment of the active armor of the present invention there are a plurality of cells as in cell 85 which is comprised of a conductive front plate 86, a conductive rear plate 88 and a medial piezoelectric plate 90 and an insulator 92. An electrostrictive material or magnetostrictive material may be substituted for the piezoelectric material in this plate 90. There are also a plurality of other such vertically oriented cells 94, 96 and 98. There are also a plurality of horizontal cells 100, 102, 104 and 106. These vertical and horizontal cells together form a plurality of L-shaped members as in member 108 which has an interior corner 110, an exterior corner 112, a vertical leg 114 and a horizontal leg 116. There are also a plurality of other L-shaped members 118, 120 and 122. L-shaped member 118 is superimposed over L-shaped member 108 such that the exterior of L-shaped member 118 is adjacent to the interior corner of L-shaped member 108. L-shaped member 120 is superimposed over L-shaped member 118 in a similar way and L-shaped member 122 is positioned in a superimposed relation over L-shaped member 120 in a similar way. It would be appreciated that a force in any direction as at force vectors 124, 126, 128, 130, 132, 134, 136 or 138 will cause current to be generated.

Figure 5:
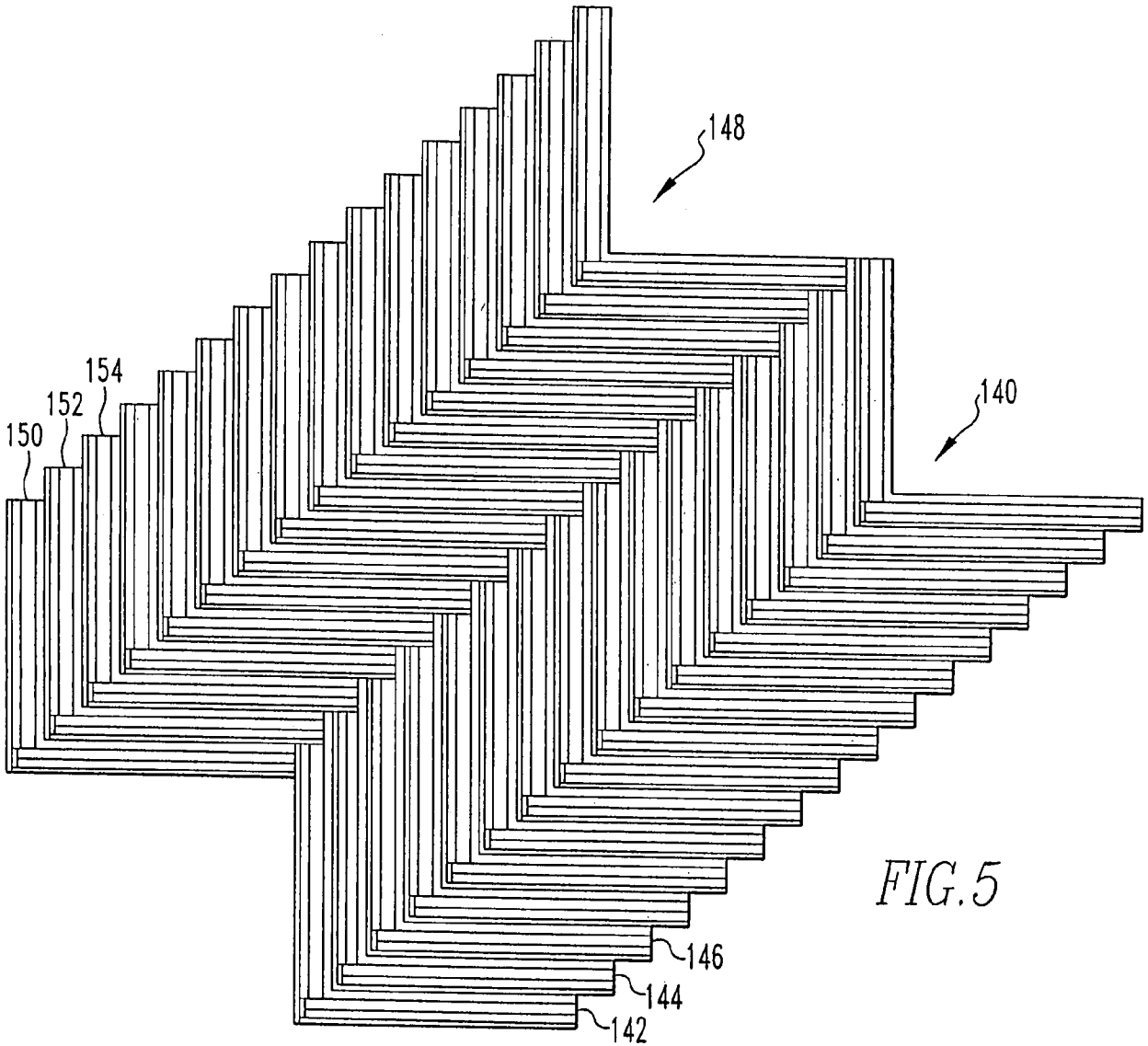
FIG. 5 is another vertical cross-sectional view of the preferred embodiment of the present invention shown in FIG. 4.

Referring to FIG. 5, an arrangement is shown in which there is a lower stack 140 of L-shaped member such as L-shaped member 142, 144 and 146. There is also an upper stack 148 of L-shaped members as at L-shaped member 150, 152 and 154.

Test

Figure 6:
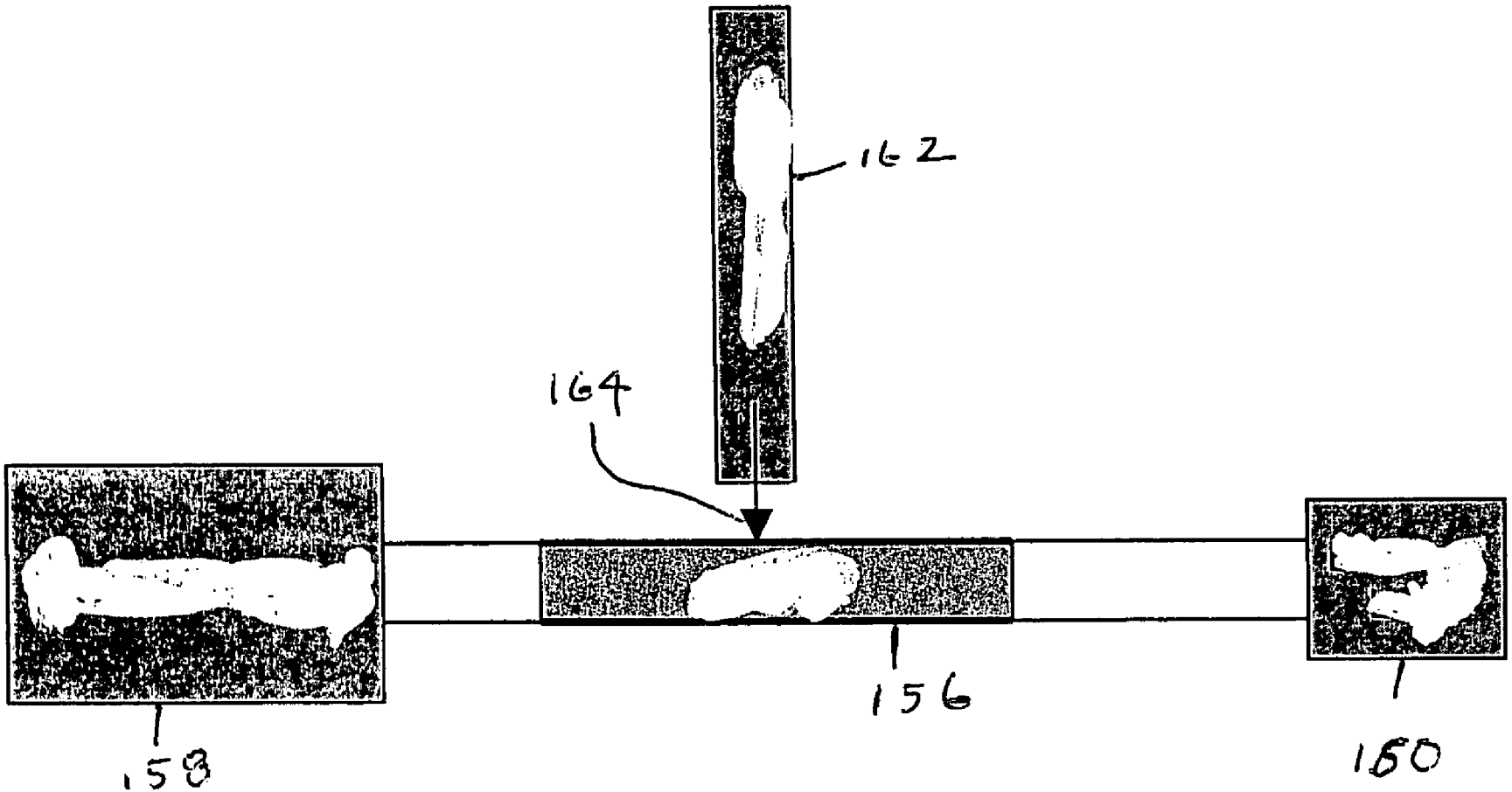
FIG. 6 is a schematic drawing illustrating a test related to the active armor system of the present invention.
Figure 7:
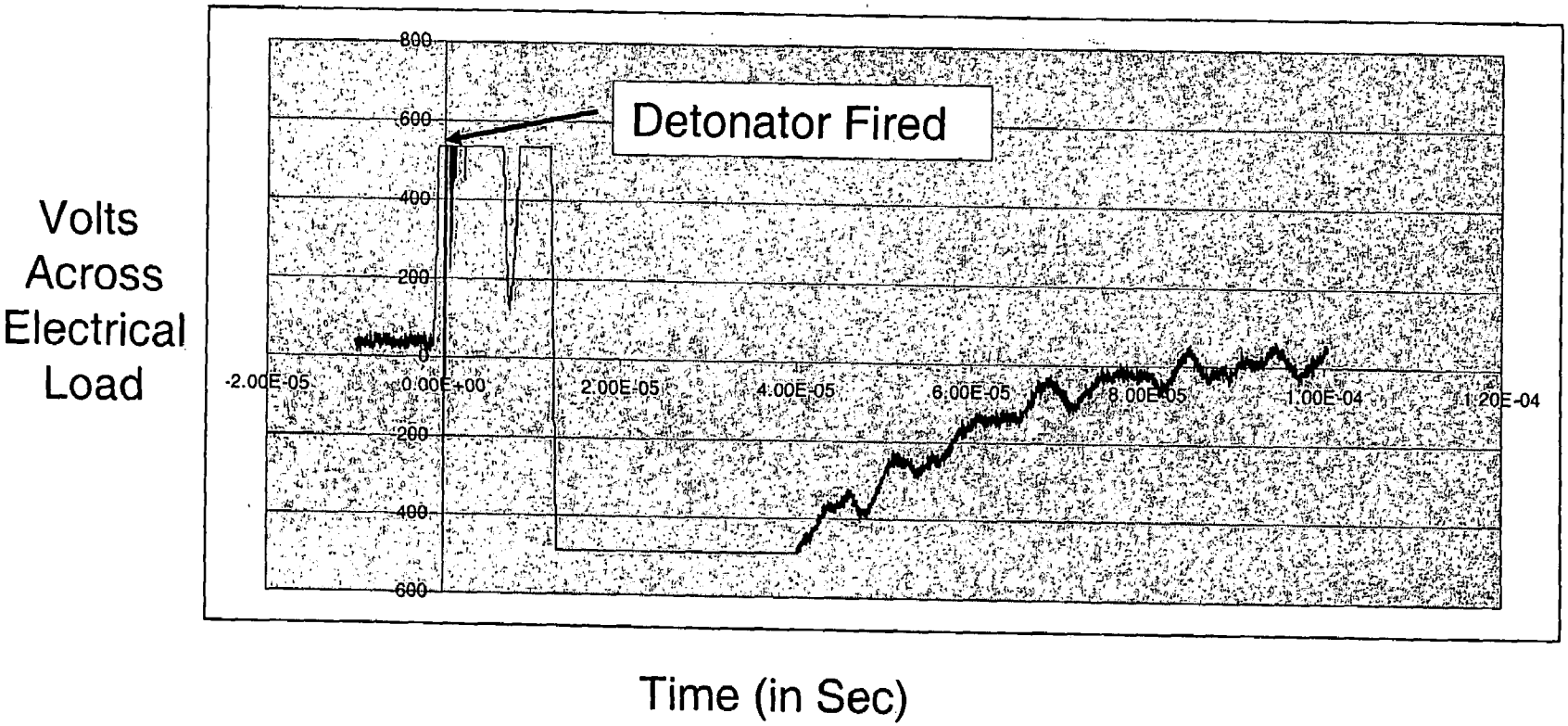
FIG. 7 is a graph of voltage vs. time from the test shown in FIG. 7.

Referring to FIG. 6, a test was conducted in which a slab of a lead zirconate titanate (PZT) piezoelectric material 156 was electrically connected to an oscilloscope 158 and an electric load 160. The size of the PZT slab was 2.00"×1.00"×0.20". A detonator 162 was positioned above the PZT slab. The detonator 162 was then fired and the blast 164 from the detonator produced the voltage shown in FIG. 7. The oscilloscope/load combination was limited to ±500 volts.

It will be appreciated that an active armor layer making use of an electrical or magnetic field in an interior air space has been described in which such field can be established without the necessity of an onboard generator.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An active armor system for protection against a shaped charge capable of producing on detonation a shock wave and a jet comprising a first armor layer having a front face and a rear face;

a second armor layer positioned in spaced generally parallel relation to the first armor layer and having a front face and a rear face;

a third layer adjacent the first armor layer which is a medial layer having a front face and a rear face and which is positioned between the first armor layer and the second armor layer and which is comprised of a magnetostrictive material selected from the group consisting of a material having a formula of Tb.sub0.27 Dy.sub0.73 Fe.sub2 and a material having a formula of Tb.sub0.27Dy.sub0.73 Fe.sub1.95; and an electrical connection between the first armor layer and the second armor layer, whereby on detonation of the shaped charge sufficient electrical energy is generated to disrupt the jet and thereby prevent penetration of the armor system.

2. The active armor system of claim 1 wherein the first armor layer is comprised of a metal or a metal alloy.

3. The active armor system of claim 2 wherein the first armor layer is comprised of a ferromagnetic metal or a ferromagnetic metal alloy.

4. The active armor system of claim 1 wherein the front face of the medial layer abuts the rear face of the first armor layer.

5. The active armor system of claim 1 wherein the second armor layer is comprised of a metal or a metal alloy.

6. The active armor system of claim 1 wherein the first armor layer is an outer layer and the second armor layer is an inner layer.

7. The active armor system of claim 1 wherein the magnetostrictive material has an additive which is selected from the group consisting of silicon and aluminum.

* * * * *